US007028613B2

(12) United States Patent
Kim et al.

(10) Patent No.: US 7,028,613 B2
(45) **Date of Patent: *Apr. 18, 2006**

(54) METHOD OF SEAMLESS PRINTING ON CLOTHING AND ARTICLES MADE THEREFROM

(76) Inventors: Robert H. Kim, 1205 W. 135th St., Gardena, CA (US) 90247; Kwan B. Lee, 1205 W. 135th St., Gardena, CA (US) 90247

( * ) Notice: Subject to any disclaimer, the term of this patent is extended or adjusted under 35 U.S.C. 154(b) by 15 days.

This patent is subject to a terminal disclaimer.

(21) Appl. No.: 10/844,198

(22) Filed: May 12, 2004

(65) Prior Publication Data

US 2005/0252392 A1 Nov. 17, 2005

(51) Int. Cl.
*B41D 7/00* (2006.01)
*B41F 23/04* (2006.01)

(52) U.S. Cl. ..... 101/33; 101/34; 101/487; 101/488

(58) Field of Classification Search ..... 101/33, 101/34, 487, 488
See application file for complete search history.

(56) References Cited

U.S. PATENT DOCUMENTS 4,627,349 A * 12/1986 Claussen ..... 101/348
4,693,179 A * 9/1987 Watts ..... 101/119
5,788,382 A * 8/1998 Egbert et al. ..... 400/118.3
6,223,799 B1 * 5/2001 Johnstone ..... 156/542
6,421,832 B1 * 7/2002 Ondrejko et al. ..... 2/69
6,640,713 B1 * 11/2003 Landsman ..... 101/467
2003/0035933 A1 * 2/2003 Stahl ..... 428/195

FOREIGN PATENT DOCUMENTS

DE DT 2433141 A1 * 10/1974

* cited by examiner

*Primary Examiner*—Andrew H. Hirshfeld
*Assistant Examiner*—Marvin P. Crenshaw
(74) *Attorney, Agent, or Firm*—Park Law Firm; John K. Park

(57) ABSTRACT

A method of printing design seamlessly on clothing, and clothing obtained thereby are provided. The method includes steps of placing a cylindrical cover around a print cylinder, placing a print medium, on which a design is printed, around the cylindrical cover, placing a cloth around print medium, and heating the print medium so that the print medium and the cloth are heated and the design is transferred from the print medium to the cloth. The transfer of the design is done by sublimation of dye, which forms the design, induced by the step of heating. The cloth is subsequently cooled and flipped.

15 Claims, 8 Drawing Sheets

METHOD OF SEAMLESS PRINTING ON CLOTHING AND ARTICLES MADE THEREFROM

BACKGROUND OF THE INVENTION

The present invention relates to a method of seamless printing on clothing, and clothing made from the method. More particularly, the invention relates to a method of printing seamless design on a seamless cloth thereby producing seamless clothing having a design printed seamlessly thereon, and articles made from the method.

Seamless clothing has no sewing line along its entire periphery and thus looks more natural and increases creativity of clothing design. Even though seamless clothing has no physical sewing line, when a design or designs are printed on the seamless clothing, some boundary lines are inevitably made due to the limits of the current printing technology. As a result, the continuous feeling the seamless clothing could not have been represented in its entirety.

New printing technology that can seamlessly print a design or designs to clothing, or seamless clothing has long been in need.

SUMMARY OF THE INVENTION

The present invention contrives to solve the disadvantages of the prior art.

An objective of the invention is to provide a method of printing a design or designs seamlessly to seamless clothing.

Another objective of the invention is to provide a fast, efficient method of seamless printing to seamless clothing.

Still another objective of the invention is to provide a seamless printing method that can print on seamless clothing of various shapes.

Still another objective of the invention is to provide clothing made from the seamless printing method.

To achieve the above objectives, the present invention provides a method of printing design on clothing. The method includes steps of placing a print medium, on which a design is printed, around a print cylinder, placing a cloth around the print medium that is placed around the print cylinder, and heating the print medium so that the design is transferred to the cloth. Preferabley, the cloth is also seamless.

In the step of heating, heating is applied inside the print cylinder. Alternatively, in the step of heating, heating is applied outside the print cylinder.

In the step of placing the print medium, the print medium contacts the print cylinder, and in the step of placing the cloth, the cloth contacts the print medium.

In the step of heating, the transfer of the design is done by sublimation of dye, which forms the design, induced by the step of heating. The print medium is a sublimation paper.

The method further includes a step of cooling the cloth after the step of heating, and a step of reversing the cloth after the step of cooling.

The method may further include a step of placing a cylindrical cover around the print cylinder before the step of placing the print medium. Then in the step of placing the print medium, the print medium is placed around the cylindrical cover. The cylindrical cover can have various sizes and shapes to accommodate various cloths.

In another embodiment, the present invention provides a method of printing design on clothing that includes steps of placing a print medium, on which a design is printed, around a preparation cylinder, placing a cloth around print medium that is placed around the preparation cylinder, moving the print medium and the cloth from the preparation cylinder to a cylindrical cover so that the print medium is placed around the cylindrical cover and the cloth is placed around the print medium, placing the cylindrical cover around a print cylinder, and heating the cylindrical cover so that the design is transferred to the cloth.

In the step of placing the print medium around the preparation cylinder, the edge of the print medium extends over the end of the preparation cylinder. In the step of moving the print medium and the cloth, the cylindrical cover is inserted into the preparation cylinder, and while holding the edge of the print medium the preparation cylinder is moved away from the cylindrical cover.

At the end of the step of moving the print medium and the cloth, the print medium contacts the cylindrical cover, and the cloth contacts the print medium.

The present invention also provides a clothing on which a design is printed by the methods described above.

The advantages of the present invention are: (1) seamless printing on a seamless cloth is possible which maximizes the decorative effect of the aesthetical representation of the cloth; (2) uniform heating and thus uniform quality printing is greatly facilitated; (3) the method can be adapted to seamlessly printing various sizes and shapes of seamless clothing; and (4) with the preparation cylinder, the cycle time of the printing is substantially reduced.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
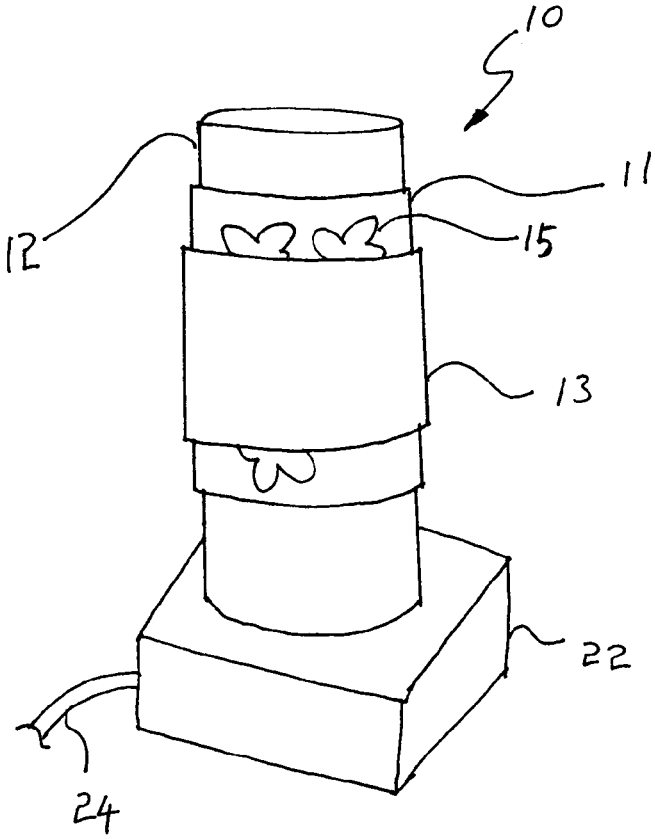
FIG. 1 is a perspective view of a printing device of the present invention.
Figure 2:
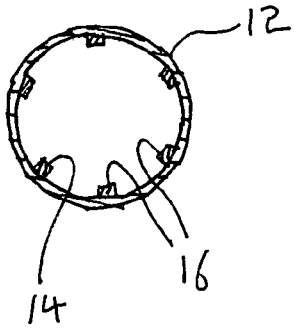
FIG. 2 is a cross-sectional view of a print cylinder with heating elements installed inside.

FIGS. 1 and 2 show a printing device 10 of the present invention. The printing device 10 is used for seamless printing on a cloth 13. During printing, a design 15 is transferred from a print medium 11 to the cloth 13. The printing device 10 includes a print cylinder 12, a heater 14 heating the print cylinder 12, a base 22 on which the print cylinder 12 is installed, and a wiring 24 that supplies power to and controls the printing device 10. The print medium 11 is placed around the print cylinder 12. The cloth 13 is placed around the print medium 11. The heating of the print cylinder 12 transfers the design to the cloth 13. The cloth 13 is also seamless. The print medium 11 closely contacts the print cylinder 12 and the cloth 13 closely contacts the print medium 11 so that heat from the heater 14 is effectively used for printing and transfer of the design is precisely performed.

Figure 3:
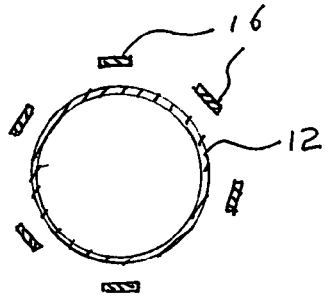
FIG. 3 is a cross-sectional view of the print cylinder with heating elements installed outside.

The heater 14 includes one or more heating elements 16 provided inside the print cylinder 12. Alternatively, the heating elements 16 may be provided outside the print cylinder 12 as shown in FIG. 3. Heating may be performed electrically or by supplying hot steam, etc.

The transfer of the design 15 is done by sublimation of dye, which forms the design 15, induced by heating of the print cylinder 12. The print medium 11 is a sublimation paper.

Pressure may be applied on the cloth 13 depending on printing method used by the printing device 10.

Figure 4:
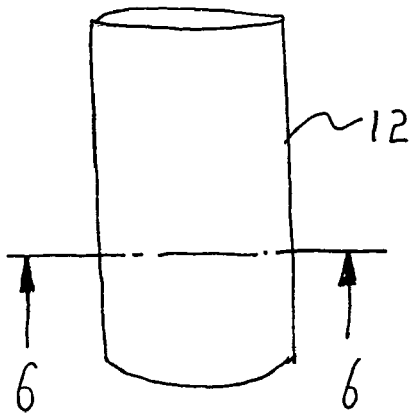
FIG. 4 is an elevation view of the print cylinder having a straight shape.

In one aspect of the invention, the diameter of the print cylinder 12 is constant along the length of the print cylinder 12 as shown in FIG. 4.

Figure 5:
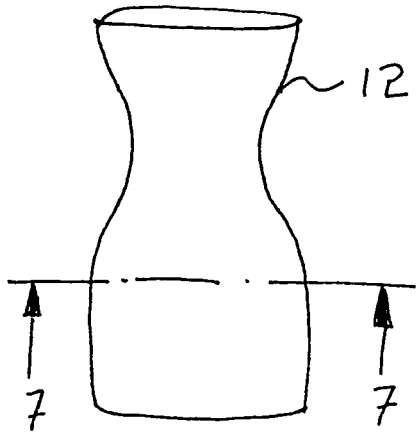
FIG. 5 is an elevation view of the print cylinder having a curved shape.

In another aspect of the invention, the diameter of the print cylinder 12 varies along the length of the print cylinder 12 as shown in FIG. 5.

Figure 6:
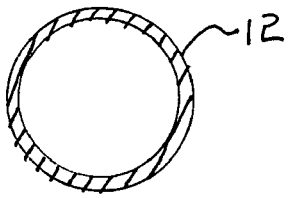
FIG. 6 is a cross-sectional view taken along the line 6—6 of FIG. 4.
Figure 7:
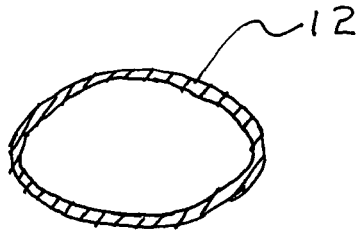
FIG. 7 is a cross-sectional view taken along the line 7—7 of FIG. 5.

The cross-section of the print cylinder 12 may be circular as shown in FIG. 6, or oval as shown in FIG. 7.

These various shapes of the print cylinder 12 in turn provides variety of shapes of the cloth 13 as the resulting products.

Figure 8:
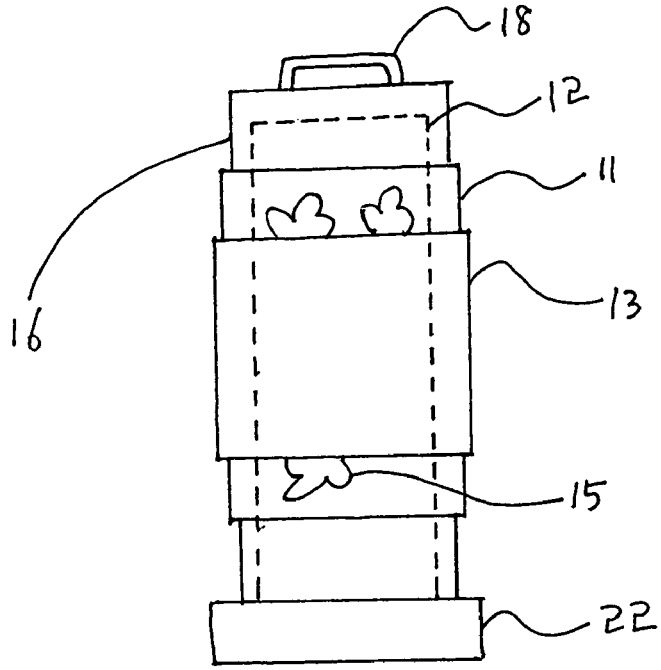
FIG. 8 is an elevation view of the printing device with a cylindrical cover.

In another embodiment, the printing device 10 may further include a cylindrical cover 16 that is placed around the print cylinder 12 as shown in FIG. 8. When the cylindrical cover 16 is used, the print medium 11 and the cloth 13 are placed around the cylindrical cover 16.

The cylindrical cover 16 includes a handle 18 that facilitates placing or replacing of the cylindrical covers 16.

The cylindrical cover 16 is made of thermally conductive material so that heat from the heater 14 is uniformly distributed throughout the cylindrical cover 16.

Figure 9:
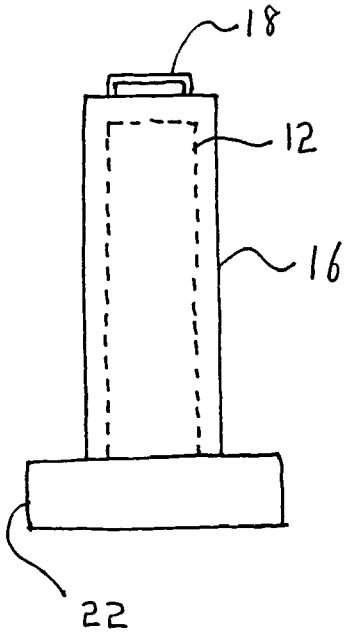
FIG. 9 is an elevation view of the cylindrical cover having a straight shape.
Figure 10:
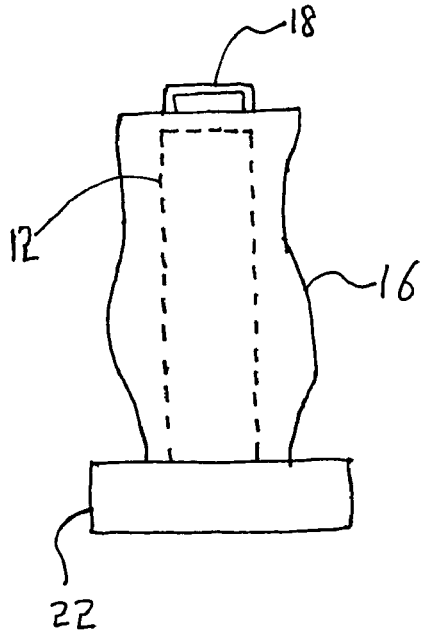
FIG. 10 is an elevation view of the cylindrical cover having a curved shape.

FIG. 9 shows that the diameter the cylindrical cover 16 is constant along the length of the cylindrical cover 16. FIG. 10 shows that the diameter of the cylindrical cover 16 varies along the length of the cylindrical cover 16. The cross-section of the print cylindrical cover 16 may also be circular or oval.

With the cylindrical cover 16, while maintaining the same print cylinder 12, various sizes and shapes of the cylindrical cover 16 may be used for the printing device 10. This greatly simplifies the construction of the printing device 10 and facilitates producing various kinds of seamless printing clothing.

Figure 11:
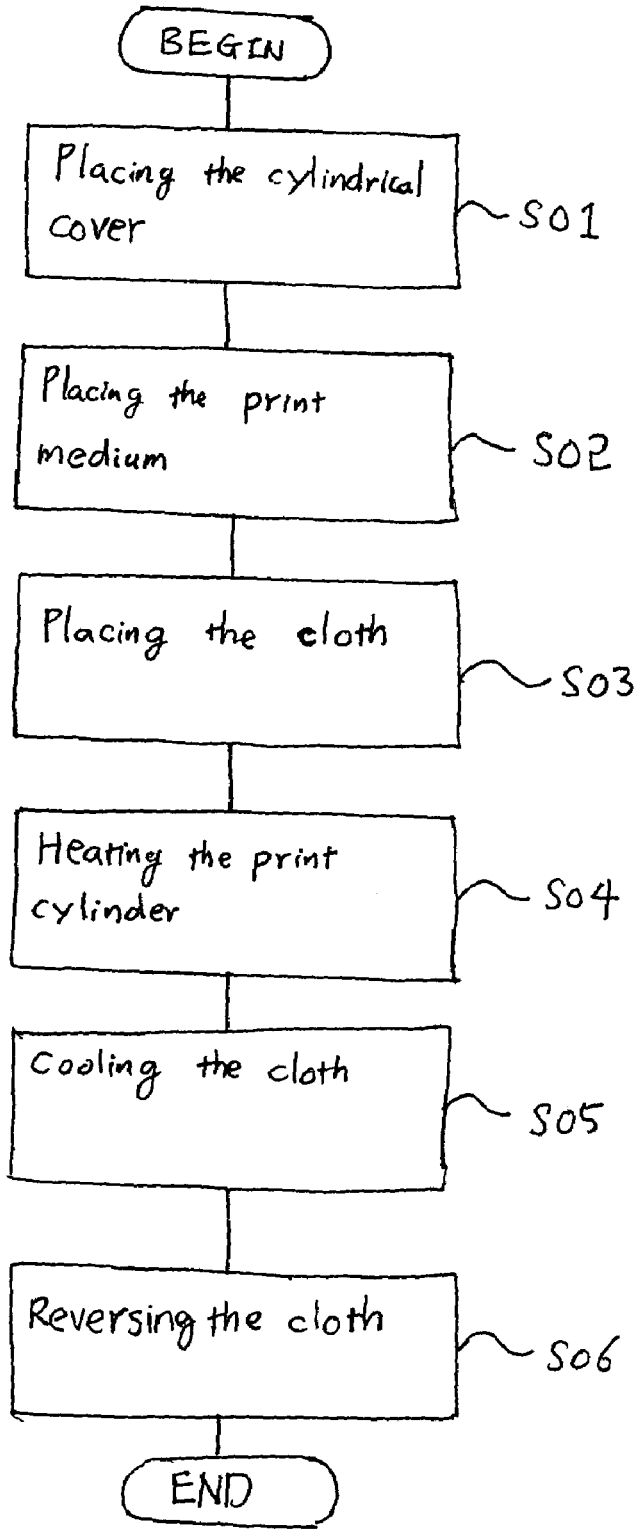
FIG. 11 is a flow diagram showing a seamless printing method of the present invention.

FIG. 11 shows a method of printing design on clothing according to the invention. The method includes step S02 of placing the print medium 11, on which the design 15 is printed, around the print cylinder 12, step S03 of placing the cloth 13 around the print medium 11 that is placed around the print cylinder 12, and step S04 of heating the print medium 11 so that the design 15 is transferred to the cloth 13.

In step S04 of heating, heating is applied inside the print cylinder 12. Alternatively, in step S04 of heating, heating is applied outside the print cylinder 12.

In step S02 of placing the print medium 11, the print medium 11 closely contacts the print cylinder 12, and in step S03 of placing the cloth 13, the cloth 13 closely contacts the print medium 11.

In step S04 of heating, the transfer of the design 15 is done by sublimation of dye, which forms the design 15, induced by the heating.

The method further includes a step S05 of cooling the cloth 13 after the step S04 of heating, and a step S06 of reversing the cloth 13 after the step S05 of cooling.

The method may further include a step S01 of placing a cylindrical cover 16 around the print cylinder 12 before the step S02 of placing the print medium 11. When the cylindrical cover 16 is used, in the step of placing the print medium 11, the print medium 11 is placed around the cylindrical cover 16.

Figure 12:
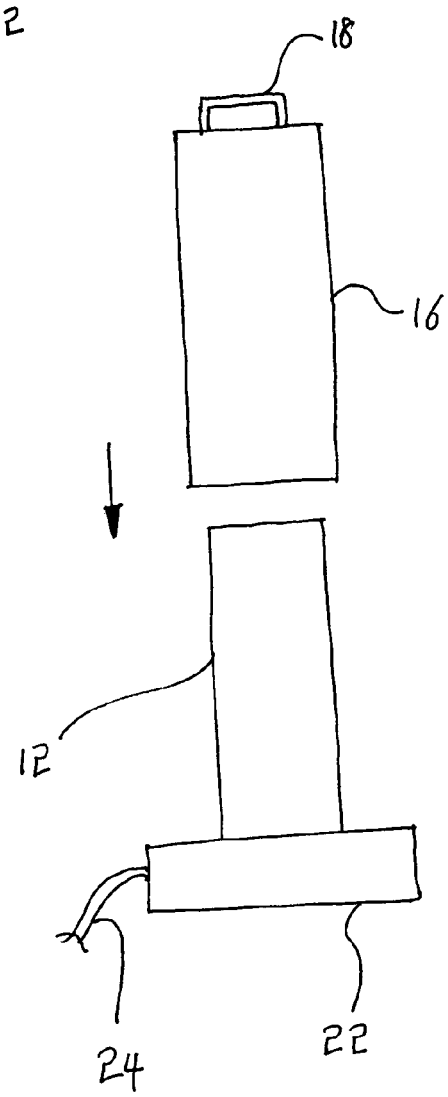
FIG. 12 is a schematic diagram showing a step of placing the cylindrical cover.

FIG. 12 illustrates the step S01 of placing the cylindrical cover 16. The cylindrical cover 16 is chosen as one having shape and size suitable for end product.

Figure 13:
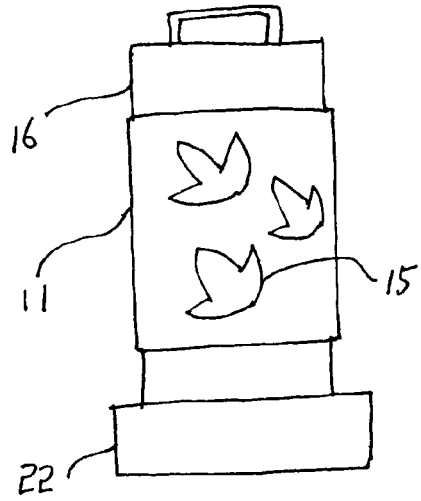
FIG. 13 is a schematic diagram showing a step of placing the print medium.
Figure 14:
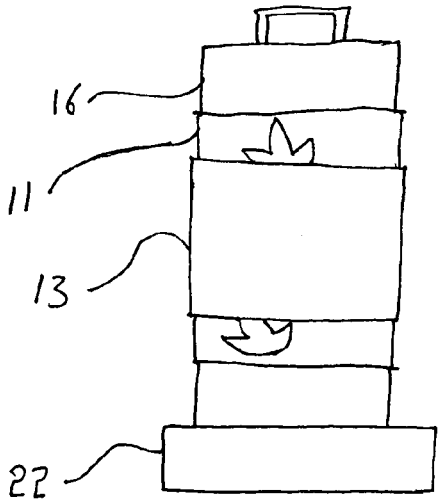
FIG. 14 is a schematic diagram showing a step of placing the cloth.
Figure 15:
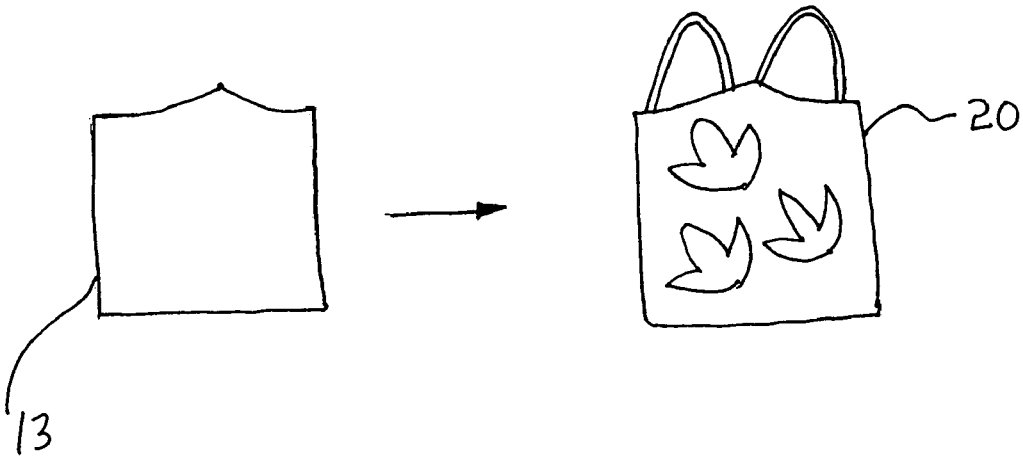
FIG. 15 is a schematic diagram showing a step of reversing the cloth.

FIG. 13 illustrates the step S02 of placing the print medium 11. FIG. 14 illustrates the step S03 of placing the cloth 13. FIG. 15 illustrates the step S06 of reversing the cloth 13. Since the design is transferred on the inside of the cloth 13 in step S04 of heating, the cloth 13 is reversed or flipped and after attaching shoulder straps, etc., a clothing 20, on which the design 15 is printed by the printing method described above, is obtained.

Since the print cylinder 12 or the cylindrical cover 16 has a continuous periphery having no discontinuous portion or a portion having sharp curvature change, a perfect seamless printing is effectively achieved. The printing device and the method of the present invention are convenient, versatile, and easy to construct or implement.

The printing device 10 illustrated in the drawings has a vertically standing structure. However, the function of the printing device 10 is not affected by the direction of the printing device 10, specifically the print cylinder 12. Thus the print cylinder 12 can be positioned horizontal or in any other direction.

Figure 16:
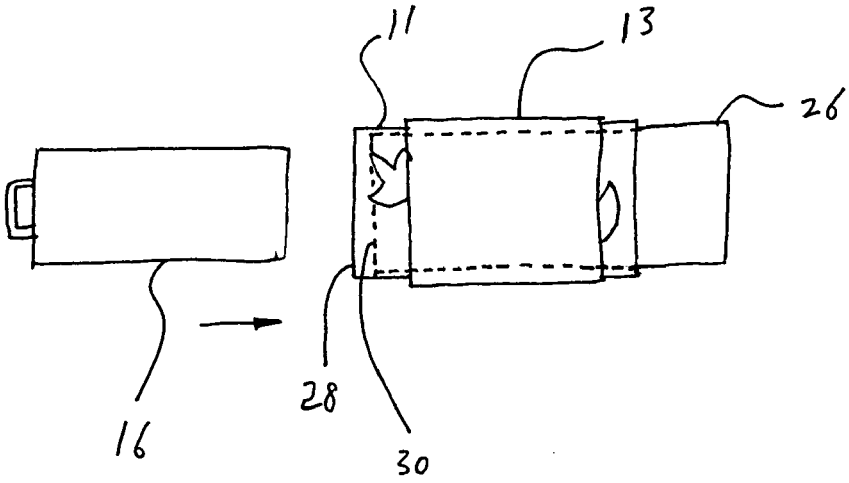
FIG. 16 is a schematic diagram showing a step of inserting the cylindrical cover into a preparation cylinder.
Figure 17:
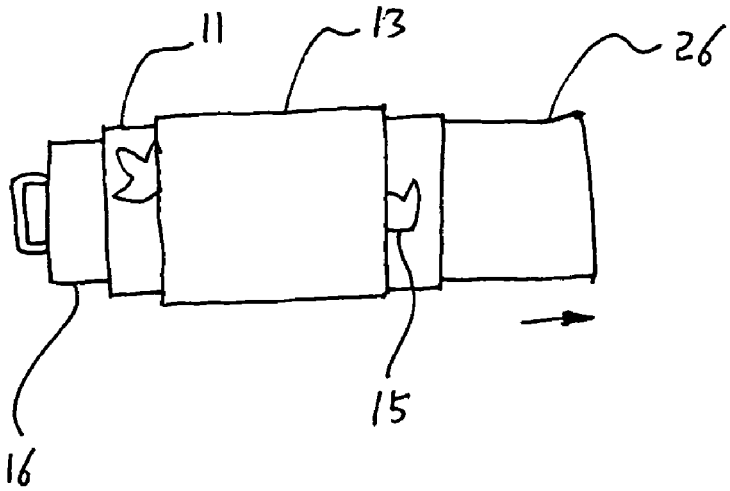
FIG. 17 is a schematic diagram showing a step of moving the print medium and the cloth from the preparation cylinder to the cylindrical cover.
Figure 18:
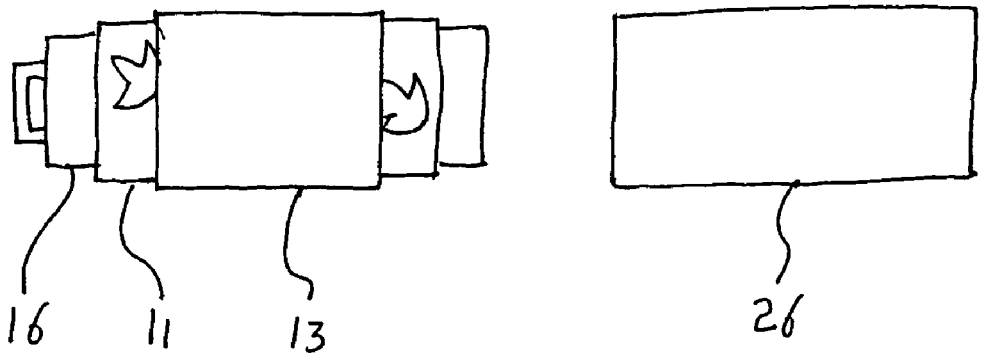
FIG. 18 is a schematic diagram showing that the cylindrical cover is separated from the preparation cylinder.

FIGS. 16–18 show that the printing device 10 further includes a preparation cylinder 26. The print medium 11 and the cloth 13 are placed around the preparation cylinder 26 at first. Then, the print medium 11 and the cloth 13 are moved from the preparation cylinder 26 to the cylindrical cover 16.

The preparation cylinder 26 is hollow, and the diameter of the preparation cylinder 26 is bigger than the diameter of the cylindrical cover 16 so that the cylindrical cover 16 can be inserted into the preparation cylinder 26.

Figure 19:
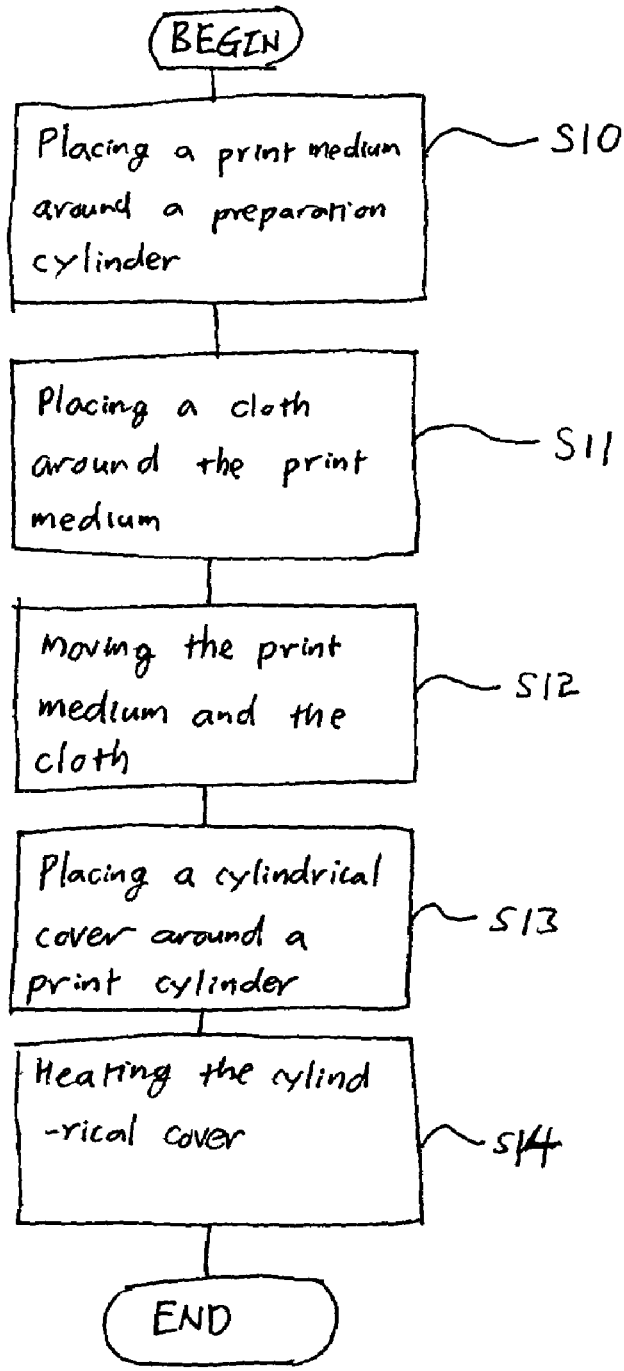
FIG. 19 is a flow diagram showing another seamless printing method of the present invention.

FIG. 19 shows a seamless printing method that utilizes the preparation cylinder 26. The method includes step S10 of placing the print medium 11, on which the design 15 is printed, around the preparation cylinder 26, step S11 of placing the cloth around print medium 11 that is placed around the preparation cylinder 26, step S12 of moving the print medium 11 and the cloth 13 from the preparation cylinder 26 to the cylindrical cover 16 so that the print medium 11 is placed around the cylindrical cover 16 and the cloth 13 is placed around the print medium 11, step S13 of placing the cylindrical cover 16 around the print cylinder 12, and step S14 of heating the cylindrical cover 16 so that the design 15 is transferred to the cloth 13.

In the step S10 of placing the print medium 11 around the preparation cylinder 26, as shown in FIG. 16, the edge 28 of the print medium 11 extends over the end 30 of the preparation cylinder 26. In the step S12 of moving the print medium 11 and the cloth 13, the cylindrical cover 16 is inserted into the preparation cylinder 26 as shown in FIG. 16, and while holding the edge 28 of the print medium 11 the preparation cylinder 26 is moved away from the cylindrical cover 16 as shown in FIG. 17.

At the end of the step S12 of moving the print medium 11 and the cloth 13, the print medium 11 closely contacts the cylindrical cover 16, and the cloth 13 closely contacts the print medium 11. The moving and positioning of the print medium 11 and the cloth 13 is facilitated with the preparation cylinder 26 having a diameter slightly bigger than that of the cylindrical cover 16, and the cloth 13 which is seamless and elastic.

With the utilization of preparation cylinder 26, cooling of the cylindrical cover 16 is not required, and the cylindrical cover 16 can be used for next printing while it is still warm. Thus the cycle time of the printing process can be substantially reduced.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A method of printing design on clothing comprising steps of:

a) placing a print medium, on which a design is printed, around a print cylinder;

b) placing a cloth around print medium that is placed around the print cylinder; and c) heating the print medium so that the design is transferred to the cloth.

2. The method of claim 1, wherein the cloth is seamless.

3. The method of claim 1, wherein in the step of heating, heating is applied inside the print cylinder.

4. The method of claim 1, wherein in the step of heating, heating is applied outside the print cylinder.

5. The method of claim 1, wherein in the step of placing the print medium, the print medium contacts the print cylinder, and wherein in the step of placing the cloth, the cloth contacts the print medium.

6. The method of claim 1, wherein in the step of heating the transfer of the design is done by sublimation of dye, which forms the design, induced by the step of heating.

7. The method of claim 6, wherein the print medium is a sublimation paper.

8. The method of claim 1, further comprising a step of cooling the cloth after the step of heating.

9. The method of claim 8, further comprising a step of reversing the cloth after the step of cooling.

10. The method of claim 1, further comprising a step of placing a cylindrical cover around the print cylinder before the step of placing the print medium, wherein in the step of placing the print medium, the print medium is placed around the cylindrical cover.

11. A method of printing design on clothing comprising steps of:

a) placing a print medium, on which a design is printed, around a preparation cylinder;

b) placing a cloth around print medium that is placed around the preparation cylinder;

c) moving the print medium and the cloth from the preparation cylinder to a cylindrical cover so that the print medium is placed around the cylindrical cover and the cloth is placed around the print medium;

d) placing the cylindrical cover around a print cylinder; and e) heating the cylindrical cover so that the design is transferred to the cloth.

12. The method of claim 11, wherein in the step of placing the print medium around the preparation cylinder, the edge of the print medium extends over the end of the preparation cylinder, wherein the step of moving the print medium and the cloth, the cylindrical cover is inserted into the preparation cylinder, and while holding the edge of the print medium the preparation cylinder is moved away from the cylindrical cover.

13. The method of claim 11, wherein the cloth is seamless.

14. The method of claim 11, wherein at the end of the step of moving the print medium and the cloth, the print medium contacts the cylindrical cover, and the cloth contacts the print medium.

15. The method of claim 11, wherein in the step of heating the transfer of the design is done by sublimation of dye, which forms the design, induced by the step of heating.

* * * * *